US006863792B1

(12) United States Patent
Madou et al.

(10) Patent No.: US 6,863,792 B1
(45) Date of Patent: Mar. 8, 2005

(54) METHOD OF MAKING ELECTROCHEMICAL DETECTORS BASED ON IRIDIUM OXIDE

(75) Inventors: Marc J. Madou, San Diego, CA (US); Sheng Yao, Upper Arlington, OH (US)

(73) Assignee: The Ohio State University, Columbus, OH (US)

( * ) Notice: Subject to any disclaimer, the term of this patent is extended or adjusted under 35 U.S.C. 154(b) by 333 days.

(21) Appl. No.: 09/975,475

(22) Filed: Oct. 11, 2001

(51) Int. Cl.[7] ..... C25B 11/00; C25D 11/02

(52) U.S. Cl. ..... 205/86; 205/229; 205/230; 205/231; 205/333; 205/543; 205/704

(58) Field of Search ..... 205/86, 229, 230, 205/231, 333, 538, 543, 704

(56) References Cited

U.S. PATENT DOCUMENTS 4,717,581 A * 1/1988 Robblee ..... 427/2.12
5,030,331 A * 7/1991 Sato ..... 205/107
5,480,534 A 1/1996 Kato et al. ..... 204/419
5,578,175 A * 11/1996 Lin et al. ..... 204/290.12

FOREIGN PATENT DOCUMENTS

WO WO 99/50277 10/1999

OTHER PUBLICATIONS

Einerhand, R. et al., "pH Measurement in Strong Koh Solutions with a Bismuth Electrode", *Electrochim. Acta,* 34, 345 (1989).
Grubb, W. et al., "Palladium–Palladium Oxide pH Electrodes", *Anal. Chem.,* 52, 270 (1980).
Liu, C. et al., "A Palladium–Palladium Oxide Miniature pH Electrode", *Science,* 207, 188 (1980).
Fog, A. et al., "Electronic Semiconducting Oxides as pH Sensors", *Sensors & Actuators,* 5, 137 (1984).

(List continued on next page.)

*Primary Examiner*—Roy King
*Assistant Examiner*—William T. Leader
(74) *Attorney, Agent, or Firm*—Standley Law Group LLP

(57) ABSTRACT

A conductive oxide solid formed through an electrochemical process. The resulting solid predominantly contains oxides of the highest oxidation state. Additionally, the solid can be thick, uniform, stable across a wide range of acidity and temperature, fully hydrated, and conductive with a very low redox potential. A preferred embodiment is an iridium solid formed at high temperature in molten carbonate, said solid containing intercalated lithium. The solid has application as an electrode with reduced drift. An electrochemical acidity sensor is disclosed which pairs an electrode bearing the solid with a reference electrode. Additionally, sensor apparatuses for measuring carbon dioxide and other materials as well as methods for measuring materials using an embedded acidity sensor are disclosed.

19 Claims, 8 Drawing Sheets

OTHER PUBLICATIONS

Pasztor, K. et al., "Electrochemically–Deposited RuO2 Films as pH Sensors", *Sensors & Actuators,* B13–14, 561 (1993).
McMurray, H. et al., "Novel Thick–Film pH Sensors Based on Ruthenium Dioxide–Glass Composites", *Sensors & Actuators,* B28, 9 (1995).
Burke, L. et al., "Preparation of an Oxidized Iridium Electrode and the Variation of its Potential with pH", *J. Electroanal. Chem.,* 163, 117 (1984).
Kinoshita, E. et al., "Polycrystalline and Monocrystalline Antimony, Iridium and Palladium as Electrode Material for pH–Sensing Electrodes", *Tananta,* 33, 125 (1986).
Hitchman, M. et al., "Evaluation of Iridium Oxide Electrodes Formed by Potential Cycling as pH Probes", *Analyst,* 113 35 (1988).
Olthuis, W. et al., "pH Sensor Properties of Electrochemically Grown Iridium Oxide", *Sensors & Actuators,* B2, 247 (1990).
Song, I., et al., "Metal Oxide/Metal pH Sensor: Effect of Anions on pH Measurements", *Corrosion,* 54, 13 (1998).
Jaworski, R. et al., "Characterization of Oxide Films Electrochemically Deposited from Solutions of Palladium Chloride and Sodium Hexachloroiridate", *J. Electroanal. Chem.,* 325, 111 (1992).
Baur, J. et al., "Electrochemical Deposition of Iridium(IV) Oxide from Alkaline Solutions of Iridium(III) Oxide", *J Electroanal. Chem.,* 443, 208 (1988).
Katsube, T., et al., "pH–Sensitive Sputtered Iridium Oxide Films", *Sensors & Actuators,* 2, 399 (1982).
Lauks, I. et al., "Electrically Free–Standing IrOx Thin Film Electrodes for High Temperature, Corrosive Environment pH Sensing", *Sensors & Actuators,* 4, 375 (1983).
Tarlov, M. et al., "Mechanistic and Response Studies of Iridium Oxide pH Sensors", *Sensors & Actuators,* B1, 293 (1990).
Kato, A. et al., "Metox pH Sensor as pH Measuring Electrode", *Anal. Sci.,* 7 supplement, 1577 (1991).
Kreider, K. et al., "Sputtered Thin–Film pH Electrodes of Platinum, Palladium, Ruthenium, and Iridium Oxides", *Sensors & Actuators,* B28, 167 (1995).
Dobson, J. et al., "EMF Measurements of Cells Employing Metal–Metal Oxide Electrodes in Aqueous Chloride and Sulphate Electrolytes at Temperatures Between 25–250 C", *Electrochim. Acta,* 21, 527 (1976).
Papeschi, G. et al., "An Iridium–Iridium Oxide Electrode for in vivo Monitoring of Blood pH Changes", *J. Med. Eng. & Tech.,* 5, 86 (1981).
Ardizzone, A. et al., Properties of Thermally Prepared Iridium Dioxide Electrodes, *J. Electroanal. Chem.,* 126, 287 (1981).
Kinoshita, K. et al., Electrochemical Measurements on Pt, Ir, and Ti Oxides as pH Probes, *J. Electrochem. Soc.,* 131, 1089 (1984).
Hitchman, M. et al., A Field–Induced Poising Technique for Promoting Convergence of Standard Electrode Potential Values of Thermally Oxidized Iridium pH Sensors, *Talanta,* 39, 137 (1992).
Hitchman, M. et al., "Thermally Grown Iridium Oxide Electrodes for pH Sensing in Aqueous Environments at 0 and 95 Degrees C", *Anal. Chim. Acta,* 263, 53 (1992).
Hitchman, H. et al., "Potentiometric Determination of Proton Activities in Solutions Containing Hydrofluoric Acid Using Termally Oxidized Iridium Electrodes", *Analyst,* 116, 1131 (1991).
Kinlen, P. et al., "A Solid–State pH Sensor Based on a Nafion–Coated Iridium Oxide Indicator Electrode and a Polymer–Based Silver Chloride Reference Electrode", *Sensors & Actuators,* B22, 13 (1994).
Izuta, K. et al., "Response of an Iridium Oxide pH–Sensor in Nonaqueous Solutions. Comparison with Other pH–Sensors", *Anal. Sci.,* 12, 905 (1996).
Gottesfeld, S. et al., "Electrochromism in Anodic Iridium Oxide Films", *J. Electrochem. Soc.,* 126, 742 (1979).
Buckley, D. et al, "The Oxygen Electrode", *J. Chem. Soc. Faraday Trans.,* 1, 72, 1896 (1976).
Burke L. et al., "A Voltammetric Investigation of the Charge Storage Reactions of Hydrous Iridium Oxide Layers", *J. Electroanal. Chem.,* 162, 121 (1984).
Pickup, P. et al., "The Influence of the Aqueous Growth Medium on the Growth Rate, Composition, and Structure of Hydrous Iridium Oxide Films", *J. Electrochem. Soc.,* 135, 126 (1988).
Conway, B. et al., "Surface and bulk Processes at Oxidized Iridium Electrodes—II. Conductivity–Switched Behaviour of Thick Oxide Films", *Electrochim. Acta,* 28, 9 (1983).
Joo, C., et al., Spectrophotometric Study of the Corrosion Behaviour of Chromium in Molten Alkali Carbonates, *J. Power Sources,* 72, 211 (1998).
Every, R., Preparation of Transition Metal Oxide–Metal Electrodes, *Electrochem. Soc.,* 112, 524 (1965).
Janz, G. et al., "Corrosion of Platinum, Gold, Silver and Refractories in Molten Carbonates", *Corrosion,* 19, 292 (1963).
Claes, P. et al., "Chemical and Electrochemical Behaviour of Copper Species in the Molten Eutectic Mixture Na2CO3+K2CO3 at 800 Degrees C", *J. Electroanal. Chem.,* 389, 37 (1995).
Spiegel, M. et al., Corrosion of Iron Base Alloys and High Alloy Steels in the Li2CO3–K2CO3 Eutectic Mixture, *Corr. Sci.,* 39, 1193 (1997).
Malinowska, B. et al., "Behaviour of Nickel Species in Molten Li2CO3+Na2CO3+K2CO3 Part 1. Thermodynamic Approach and Electrochemical Characterization Under P(CO2)=1 atm", *J. Electroanal. Chem.,* 21, 389 (1995).
Cassir, M. et al., "Thermodynamic and Electrochemical Behavior of Nickel in Molten Li2CO3–Na2CO3 Modified by Addition of Calcium Carbonate", *J. Electroanal. Chem.,* 452, 127 (1998).
Nishina, T. et al., "Gas Electrode Reaction in Molten Carbonate Media", *J. Electrochem. Soc.,* 141, 1191 (1994).
Ta, K. et al., "Proton Intercalation Hysteresis in Charging and Discharging Nickel Hydroxide Electrodes." *J. Electrochem. Soc.,* 146, 8 (1999).
Ranganathan, S. et al., "Photoresist–Derived Carbon for Microelectromechanical Systems, and Electrochemical Applications", J. Electrochem. Soc., 147, 1 (2000).
Yao, S. et al., "Potentiometric Carbon Dioxide Sensor Based on Iridium Oxide pH Electrode", Electrochemical Society Proceedings 99–23.
Yao, Sheng et al., A Novel Iridium Oxide PH Electrode, Electrochemical Society Proceedings, vol. 99–23, pp. 53–61.
Yao, Sheng et al., A pH Electrode based on Melt–Oxidized Iridium Oxide, Journal of The Electrochemical Society, vol. 148, Issue 4, pp. H29–H36 (Apr., 2001).
Aizawa, M. et al., Chemical Sensors IV, PV99–23, Honolulu, Hawaii (Fall, 1999).

* cited by examiner

METHOD OF MAKING ELECTROCHEMICAL DETECTORS BASED ON IRIDIUM OXIDE

This invention was made with United States Government support. Accordingly, the United States Government may have certain rights in the invention.

TECHNICAL FIELD OF THE INVENTION

The present invention is in the field of electrochemical detection.

BACKGROUND OF THE INVENTION

This invention relates generally to electrochemical detection. More specifically, this invention relates to a carbon-based eletrochemical detection electrode.

Acidity (pH) is an important parameter measured in areas such as industrial process control, analytical chemistry, biomedical monitoring, and medical diagnosis. Conventional potentiometric acidity sensors have principally used glass electrodes to achieve acceptable sensitivity, selectivity, and lifetime. These glass electrodes, however, are generally not impervious to chemical attack or extreme pH levels. These electrodes also have other problems, in that they are generally not useful in wide ranging pressure or temperature environments, may be slow to respond, and are typically difficult to mass-produce at a reasonable cost. They can also be difficult to miniaturize, must be read by expensive meters adapted to use teraohm impedance signal transmission in order to compensate for the high resistance of a glass membrane, are not mechanically robust, and are potentially dangerous when used for food testing or in the human body.

Acidity-sensitive field effect transistors (pH-ISFETs) and potentiometric metal oxide pH electrodes (MOES) have been recently developed for acidity measurements. These electrodes can be manufactured as sensors that are small, rugged, and fairly reliable, but are not incredibly accurate. The pH-ISFETs typically rely on metal oxides as pH-sensitive gate insulator materials, such as $SiO_2$, $ZrO_2$, $Al_2O_3$, or $Si_3O_4$. Polarization of the gate films, thermal sensitivity, and photo induced junction leakage currents all induce significant drift of the sensor signal. The need for frequent calibration makes these pH-ISFETs unsuitable for continuous acidity testing.

A number of metal oxides such as $Sb_2O_3$, $Bi_2O_3$, PdO, $IrO_2$, $RuO_2$, $ZrO_2$, and $TiO_2$ have been investigated for use in potentiometric pH electrodes. The resultant drift of the electrode potential using these materials necessitates frequent calibration and limits their use use to short-term applications. The potential drifts over time due to the formation of intermediate valence oxides on the metal surface and interference of dissolved oxygen in the test solution. Metal oxides like PdO may have lower drift as electrodes, but exhibit serious redox interference.

Oxides of iridium (written $IrO_x$) have exhibited favorable properties when used as potentometric pH electrodes, having significant advantages over glass electrodes and other metal oxide pH electrodes. These advantages have traditionally included low impedance, fast response even in non-aqueous solutions, good stability over a wide pH range, stability at temperatures up to 250° C., stability at high pressure, and chemical resistance. The fabrication methodology that is used has been shown to strongly influence the performance of these $IrO_x$ based pH electrodes. These fabrication methods mainly include electrochemical growth, electrochemical deposition, reactive sputtering, and thermal preparation.

Some of these $IrO_x$ electrodes exhibit good pH sensitivity and selectivity over cations, but redox interference and drift in general still represent significant problems. Improving electrode stability typically requires optimizing the preparation conditions and using surface treatments.

The potential drift, which may lead to errors in pH measurement, still remains a serious obstacle to the development of commercial pH electrodes based on $IrO_x$. The magnitude of the potential drift seems to depend strongly on the preparation method. A mixed potential drifts and is sensitive to redox interference. The potential drift phenomena is a result of various factors, such as the oxidation state of the $IrO_x$, the degree of hydration of the oxide, pinholes in the oxide film, and impurities in the oxide film. All of these factors are influenced by the preparation method of the oxide film and affect the long-term stability of the electrode. If the equilibrium between the different oxidation and/or hydration states is disturbed by environmental changes, the equilibrium will move, resulting in the potential drift phenomena. The drift is usually a slow process, but in some cases it can be as fast as 100 mV per hour.

It is therefore an object of the invention to develop a method for making sensors that can overcome the above-mentioned limitations.

SUMMARY OF THE INVENTION

The present invention includes methods for making oxide solids of iridium, extendable to other solids like oxides or chlorides of other materials like ruthenium or silver. These solids are used to make electrodes for acidity sensors. Compound sensors may then be made using the electrodes such as carbon dioxide sensors. The present invention includes devices and systems using these sensors.

Another embodiment of the present invention includes an oxide solid that is entirely in its highest oxidation state. The solid is fully hydrated, thick, uniform, and stable across a wide range of acidity and temperature. A solid of the present invention is mechanically stable; that is to say, the thermal expansion quotient of the solid is similar to the thermal expansion quotient of the substrate metal. A solid of the present invention is also chemically stable across a wide range of acidity and temperatures. A solid of the present invention is not brittle and is preferably devoid of pinholes. The solid is preferably also conductive, with a very low redox potential, and compact. It is most preferred that a solid of the present invention be a semiconducitve oxide, exhibiting relatively low electron exchange and relatively high proton exchange at the surface. It is therefore most preferred that the electron exchange is minimized by choosing a less conductive oxide, typically a semiconductor with a wide band gap, and maximizing the proton exchange by having the surface of the material covered with as many ionizable—OH groups as possible over the whole pH range. It is most preferred that the redox potential of the metal oxide to return to a metallic state be close to 0. Further, the oxide is an oxide of intermediate band gap, below 4, but not so low as to produce a degenerate semiconductor. It is preferred that the oxide layer contain a high concentration of readily ionizable OH groups and a surface are that exposes the OH groups to the analyte. Optimally, all of the groups sticking out into solution are —H groups and the oxide is hydrated so that there is more than one monolayer of sites (say $6\times10^{14}/cm^2$) contributing to the pH signal and also less probability of a low selectivity. It is most preferred that the —OH groups are in fast equilibrium with the protons in solution to produce a more linear response.

Another embodiment involves an acidity sensor having similar properties, as well as low drift and high reproducibility. The acidity sensor also exhibits a long lifetime, low/no maintenance, high accuracy, compact size, high durability, no glass, low requisite source impedance, and safety in medical applications.

Yet another embodiment includes a carbon dioxide sensor with all the above properties, as well as being suited for determining hypercarbia in vivo. Also included in the present invention are sensors, with the above properties, useful in measuring concentrations of urea, oil degradation, and other materials.

The present invention also includes a method for forming such a solid, acidity sensor, carbon dioxide sensor, urea sensor, oil degradation sensor, or other electrochemical sensor having the above properties. A preferred method may accomplish this at low fixed and variable cost, low sensor-to-sensor variation, and highly scalable production volume. The semiconductor oxide may be formed by processing a single element substrate, such as Ir, or by processing an alloy, such as Ir—Ta. For the alloy, both metals would have to be pushed to their respective full oxidation states (for example, $IrO_2$ and $Ta_2O_5$). Other advantages and applications of the invention will become clear to one of ordinarily skill in the art based on the disclosure herein.

Although described with respect to the fields of electrochemical detection, it will be appreciated that similar advantages to those listed above may obtain in other applications of the present invention. Such advantages may become apparent to one of ordinary skill in the art in light of the present disclosure or through practice of the invention.

DETAILED DESCRIPTION OF THE PREFERRED EMBODIMENT(S)

Figure 1:
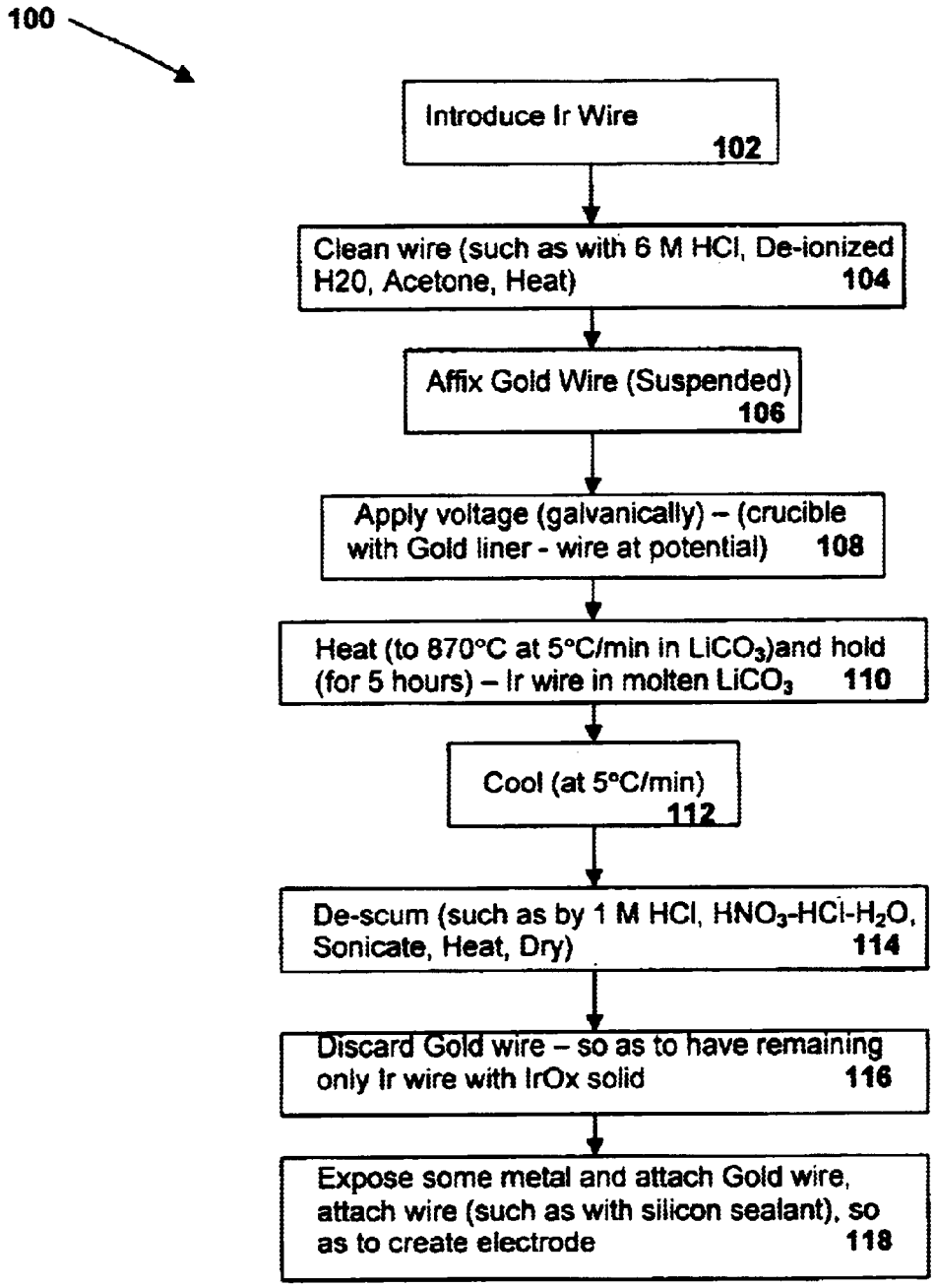
FIG. 1 is a flowchart showing the steps for forming an electrode in accordance with one embodiment of the present invention.

A preferred embodiment of the present invention includes electrodes consisting of iridium wires coated with a 20 $\mu$m thick, black colored iridium oxide solid. A method of forming these electrodes, as shown in FIG. 1, is described below.

In a preferred method of forming an iridium oxide ($IrO_x$) solid, clean iridium metal is exposed to molten carbonate at a high temperature. In order to properly clean the metal before oxidation, an iridium metal wire (preferably 0.127 or 0.25mm in diameter, 99.8% purity, as may be obtained from Alfa AESAR) is cut into pieces of about 10 mm in length and ultrasonically cleaned with acetone, 6M HCl and de-ionized water for 10 min each. The metal pieces are then dried at 120° C. for 1 hour in an electric oven. The cleaned wires are then placed in an alumina or other appropriate crucible lined with a thin gold foil and covered with fine powder of alkali metal carbonate (e.g. lithium carbonate or sodium carbonate, anhydrous, purity>99%, as may be obtained from Alfa AESAR).

The oxidation of the wire may be performed in any appropriate manner, but is preferably accomplished in an electric furnace in an air atmosphere. The temperature of the furnace is preferably increased gradually from room temperature to 870° C. at a rate of about 5° C./min, then held at this temperature for approximately 5 hours. At this temperature, lithium carbonate may be safely maintained in a liquid state during the experiment without significant decomposition.

A preferred method immerses the metal (surface) in a carbonate melt (liquid). Other methods for conducting this step may include applying the liquid carbonate to the metal surface, depositing the metal and carbonate (e.g. by CVD) sequentially or intermixed and heating until one liquefies, bombarding the carbonate with ions containing the metal, bombarding the metal with ions containing the carbonate, condensing the hot carbonate from its vapor phase onto the metal, condensing the hot metal from its vapor phase onto the carbonate, and so forth.

In a preferred method, lithium is used in creating the solid, introduced by way of lithium carbonate. Lithium is believed to be beneficial to the creation, to the extent that it assists in forming uniform, highly oxidized $IrO_x$ crystals. The lithium leads to iridium oxide crystals whose structure or distribution differs from crystals formed in the absence of lithium, and also supports the participation of highly oxidizing ions during solid formation. Lithium is present in the solid itself in a preferred apparatus for the electrode, and may be involved during operation of the electrode in charge transfer, as Li+ions, between the solid and the material under test, in preference to electrons transferring charge. The participation of lithium intercalates in the operation of the electrode is consistent with the insertion and ejection of protons described by Ta and Newman, incorporated herein by reference. An aspect of the present invention is the generalization of proton injection and insertion to lithium intercalates in a manner not taught by Ta and Newman.

Voltage is preferably applied between the metal and the melt in order to drive the oxide toward, or into, a particular oxidation state, but preferably the most oxidized state. A preferred device that may be used in applying the potental difference is the galvanic potential across a bimetallic junction, such as between an iridium material and a crucible bearing molten lithium carbonate due to a gold wire shorted to the crucible and unimmersed end of the iridium. Another possible devices utilize the potential from a voltage-regulated power source connecting the metal and carbonate in a circuit, or may utilize the potential from a battery connecting the metal and carbonate in a circuit.

Since the oxide is more resistive than the bulk metal, the resistance across the oxide indicates the extent of oxide formation. The formation process uses approximately 1 millicoulomb of charge per $cm^2$ of monolayer. Different DC voltages may be advantageous at different stages of the oxidation process. AC voltage waveforms may also be useful for accelerating or retarding oxide formation.

The materials and structures are preferably chosen to suppress electron transfer in favor of ionic or proton transfer. The surface-to-volume ratio of the oxide crystals, the effective (fractal) area of the solid, and the (unitless) aspect ratio of the metal itself as a circuit should therefore all be maximized to the extent possible.

TABLE 1

Performance of iridium oxide based pH electrodes made by various methods.

| Method | Electrode | Sensitivity (mV/pH) | E° (mV vs. SHE) | Total drift (mV) | Authors/Year |
|---|---|---|---|---|---|
| Electrochemical Growth (AIROF) | $IrO_2$/Ir wire(0.5 mm diam) | 77.7 (25° C.) | 1240 | ? | Burke. et al.[10] 1984 |
| | $IrO_2$/Ir wire(0.6 mm diam) | 71.2 | 714 | ? | Kinoshita E. et al.[11] 1986 |
| | $IrO_2$/ Ir wire(1 mm diam) | 81 (25° C.) | 1043 | 8 | Hitchman, et al.[12] 1988 |
| | $IrO_2$/Ir wire (0.15 mm diam) | 62~74 (21° C.) | 734~1066 | 15~130 | Olthuis, et al.[13] 1990 |
| | $IrO_x$/Ir wire(0.5 mm diam) (deeper purple tint) | 74~78 | 909~934 | ? | Song, et al.[14] 1998 |
| Electrochemical deposition | (Pd—Ir)$O_x$/glassy carbon (3 mm diam) | 62 (pH < 6, 21° C.) 83 (pH > 6) | 910 ± 6 (pH < 6) 1020 ± 20 (pH > 6) | ? | Jaworski, et al.[15] 1992 |
| | $IrO_x$/glassy carbon (1.5 mm diam) (bright blue) | 63~82 | 740~920[b] | 25 | Baur, et al.[16] 1998 |
| Sputtered coating (SIROF) | $IrO_x$/Ta or stainless steel (1500Å, dark blue) | 59.5 (19° C.) 68.8 (80° C.) | 1042 | 220 | Katsube, et al.[17] 1982 |
| | $IrO_x$/alumina (1500–7500Å) | 55~60 (22° C.) | 995 ± 35 | 200 | Tarlov, et al.[19] 1990 |
| | $IrO_2$/sapphire sheet (1000Å, dark blue) | 59 (25° C.) | 680[b] | 10 | Kato, et al.[20] 1991 |
| | $IrO_x$/alumina or silicon wafer | 54~49 (22° C.) | 1016 | 150–200 | Kreider, et al.[21] 1995 |
| Thermal method | $IrO_2$/Ti ($IrCl_3$ decomposition) | 59 | 950 | ? | Ardizzone, et al.[24] 1981 |
| | $IrO_2$/Ti ($IrCl_3$ decomposition) | 59 (25° C.) | 902 | 80 | Kinoshita K. et al.[25] 1984 |
| | $IrO_x$/Ir wire (blue-black) | 59 (25° C.) 59 (25° C.) | 1000~1172 870(after pre-treatment) | 200 10 | Hitchman, et al.[26] 1992 |
| | Nafion/$IrO_2$/Ti ($IrCl_3$ decomposition, blue-black) | 51~56 (22° C.) | 850~856 | ? | Kinlen, et al.[29] 1994 |
| Printing method | $IrO_2$/inert matrix | 59.8 (25° C.) | 900 | ? | Fog, et al.[7] 1984 |

[a]Different papers report drift data over varying period of time.
[B]Data vs. Ag/AgCl (reference electrode potential value was unclear).
? Data unclear.

A preferred method for making iridium oxide films using a carbonate melt can be compared to a conventional thermal method using a nitrate melt. The reaction medium in the two methods shows a significantly different acid-base behavior, since carbonate melt exhibits a strong alkaline behavior while nitrate melt is nearly neutral. The oxidation temperature is limited primarily by the melting point and decomposition temperature of the salt used. The temperature used in the carbonate method is typically much higher (870° C.) than that in the nitrate method (420° C.). It is believed that both the acid-base behavior of the reaction medium and the reaction temperature are crucial for the formation of a metal oxide film, since these factors greatly affect the solubility of the oxide produced in the melt, the properties, and even the composition of the oxide material.

Oxygen is needed in the oxidation reaction (method) and in the oxide (apparatus). In a preferred method, the reaction obtains oxygen,from the molten lithium carbonate. Alternatively, oxygen can be drawn from ambient $O_2$ by carrying out the above reaction in air, or from an oxide such as a mixed oxide of the metal. The reaction may also be accomplished in a combination of the above or with the carbonate. It is believed that extremely oxidizing ions, such as peroxides or superoxides, are present during solid formation and participates in the formation process by helping to drive the iridium oxide into its highest oxidation state.

The oxidizing species in carbonate differ from the species in conventional thermal methods. In a nitrate melt the oxidant is $KNO_3$ itself, while in a carbonate melt it is $O_2^{2-\square}$ produced from dissolved $O_2$ in the air. The carbonate melt will lose its oxidizing ability towards metals if not provided with sufficient $O_2$. In general, the oxidation condition in a carbonate melt is more severe than that in a nitrate melt. To oxidize some metals, such as Nb, Pd, Ta, etc., in a nitrate melt, the oxidation can happen only with an externally applied potential (electrolysis). A carbonate melt can oxidize metals such as Ni, Pt, Ag, Cu and Fe without electrolysis, although an applied potential may still be advantageous. The corrosion (oxidation) behavior of Ni metal in a carbonate melt, mostly in an eutectic $(Li_{0.62}K_{0.38})_2CO_3$ mixture, has been investigated extensively to improve the performance and lifetime of Ni cathodes in molten carbonate fuel cells (MCFC) where the carbonate melt is used as an electrolyte. The oxidation mechanism of a metal in a carbonate melt involves the formation of a peroxide ion ($O_2^{2-}$). In this process, oxygen from the atmosphere dissolves in the melt and reacts with carbonate ions to form peroxide ions:

$$O_2(\text{diss.})+2CO_3^{2-}=2O_2^{2-}+2CO_2$$

In reaction with the metal, the highly active peroxide ion is reduced according to:

$$O_2^{2-}+2e^-=2O_2^-$$

While the metal M is being oxidized:

$$M=M^{2+}+2e^-$$

Hence, the overall reaction is the oxidation of the metal by $O_2^{2-}$ $$2M+2O_2^{2-}=2MO+2O_2^-$$

The solubility of the metal oxide produced in the carbonate melt is critical for the formation of the above oxide film on the metal surface. If the metal oxide is soluble, such as in the case of $Cr_2O_3$ where soluble chromate forms, the melt will dissolve the oxide without precipitation of an oxide layer. On the other hand, if the oxide is insoluble, a stable oxide layer may form as in the current case where an iridium oxide layer grows on the Ir surface.

An objective of the method is therefore to form the oxide solid with all iridium oxide compounds in the same oxidation state, preferably the highest oxidation state. The crystals of oxide will advantageously be nearly uniform in size and orientation. Accuracy is improved by maximizing the uniformity of the solid—crystal size, redox state, hydration, etc.—as well as maximizing the solid's coverage, surface area and oxidation state.

Figure 2:
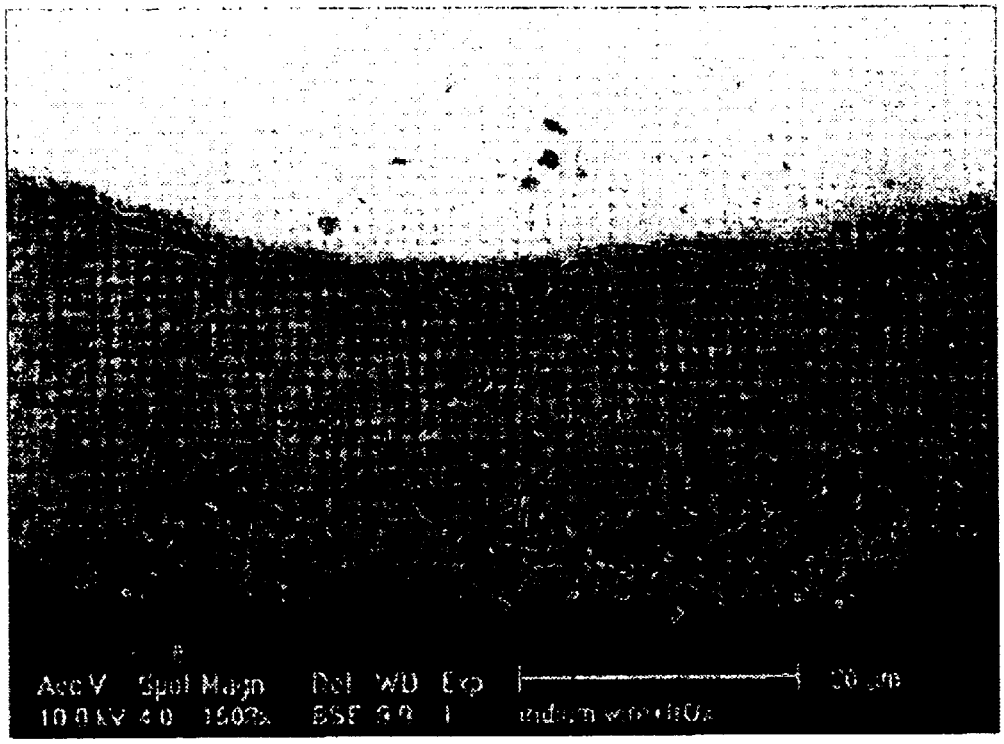
FIG. 2 is a photograph of a solid in accordance with one embodiment of the present invention.

Referring now to FIG. 2, an advantage of this solid over prior solid structures is its thickness (e.g. 20 $\mu$m), and an advantage of this method over prior methods is its production of thicker solids. The solid should completely cover the bare metal and avoid any pinholes or trapped cavities, thereby avoiding some of the sources of error and drift afflicting traditional sensors. Otherwise, exposed metal can present mixed oxidation states; thin oxides can break; and cavities can trap fluid, or create memory effects or hygroscopic effects.

It is advantageous for the solid to exhibit negligible difference between dry and fully wetted conditions. Compound sensors may include membranes, however, which may lack the hydration stability.

Iridium oxide is used for the preferred apparatus since it shows excellent chemical stability across a wide range of acidity, responds quickly, withstands high temperatures and pressures, and has low impedance. Oxide coatings have been created by several techniques, including electrochemical methods, reactive sputtering, and thermal preparation. It is anticipated that other materials may be used in accordance with the present invention, including metals other than iridium and compounds other than oxides, especially if these materials provide sufficiently low redox potential. Transition metal oxides of Ru, Pt, Ir, Pd, Zr, Ti, and so forth are promising in this regard, especially if lithium is allowed to intercalate them.

Returning to the description of a preferred iridium oxide solid and preferred formation method therefor, it is noted that after the clean iridium metal has been oxidized in molten lithium carbonate, the coated wire may need to be cooled and descummed. Cooling may occur during, after, or prior to the descumming, but it is preferably done first, by cooling down the oven to room temperature at about 5° C./min. The temperature profile during cooling should minimize metal fatigue (by not being too fast) and minimize diffusion effects (by not being too slow).

In order to descum by a preferred method, the crucible containing the wires and solid carbonate should be immersed in a 1M HCl solution for about twelve hours in order to dissolve the carbonate. Other solvents may be used in the method, particularly those having appropriate parameters of concentration, temperature, and pressure. The oxidized iridium wires are then preferably treated ultrasonically in a $HNO_3^-HCl^-{}^H{}_2O$ (1:3:2) or other appropriate solution for approximately ten minutes, then rinsed with de-ionized water and stored in de-ionized water overnight to remove the acid and any other soluble components attached to the oxidized wires. The wires may then be allowed to dry on filter paper at 120° C. overnight.

Figure 3:
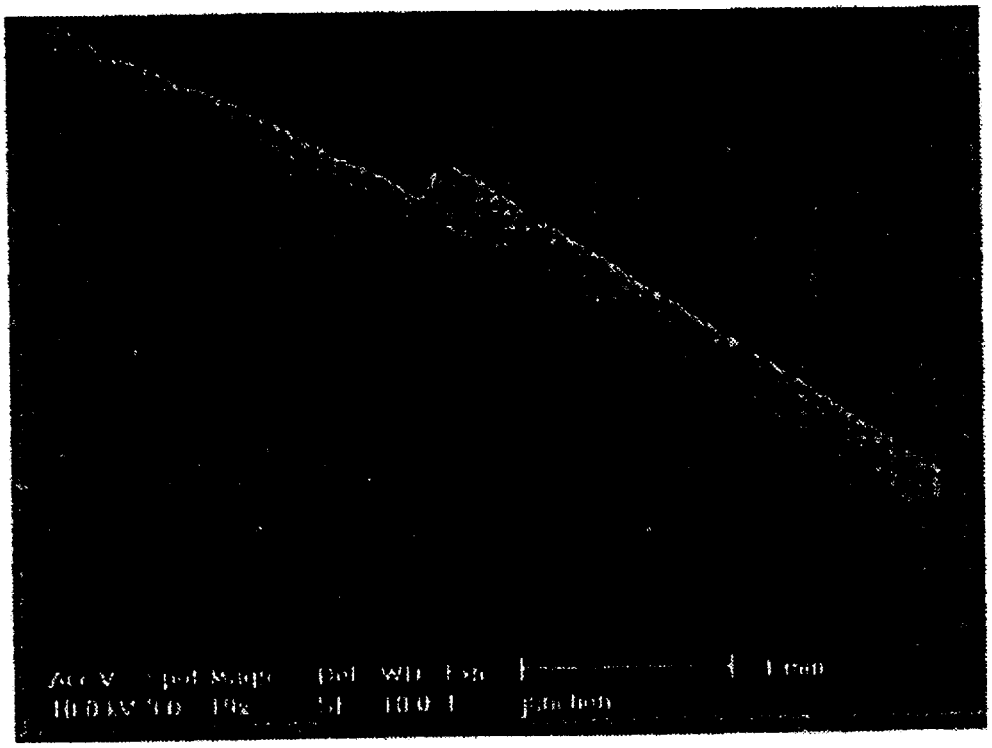
FIG. 3 is a photograph of an electrode in accordance with one embodiment of the present invention

Referring now to FIG. 3, there are numerous known ways to attach electrical leads to the wire. In a preferred method, the gold wires used to suspend the iridium wires and hold them at a galvanic potential with respect to the carbonate melt are removed and discarded during the descumming step. These wires could instead be retained in place for later use as electrical leads. If the iridium wire is fully coated, a patch of oxide can be scraped away after descumming and a gold wire affixed by spot welding. Alternatively, the electrical lead may be built in place before the solid is formed, possibly with a barrier layer, and the iridium metal sputtered onto it with the oxide subsequently formed above the iridium metal. Since galvanic potential across bimetallic junctions affects the voltage measured around the full circuit, care must be taken in selecting the metals used to form electrical leads, bonds, solders and welds. In a preferred embodiment, a small area of the iridium oxide film at one end of the oxidized wire is carefully scraped off with a knife in order to expose the underlying Ir metal to make an electrical contact. A gold wire (0.1 or 0.25 mm in diameter) may be used as a lead wire because of its chemical, electrical, and mechanical properties. The gold wire is preferably wound around the bare end of the Ir wire in order to form a good physical and electrical connection. It is advantageous to solder the gold wire thermally onto the oxidized iridium wire. It is most advantageous to attach the gold lead wire to the iridium wire prior to oxidation to maximize contact between the two wires. The contact area and the lead wire may then be insulated completely by an organic adhesive (such as silicone adhesive commercially available from Fisher Scientific) to keep the contact and lead wire dry.

The solid, any metal substrate, and any electrical lead together comprise an electrode of the present invention, preferably $IrO_x$ on Ir with a gold wire.

Figure 4:
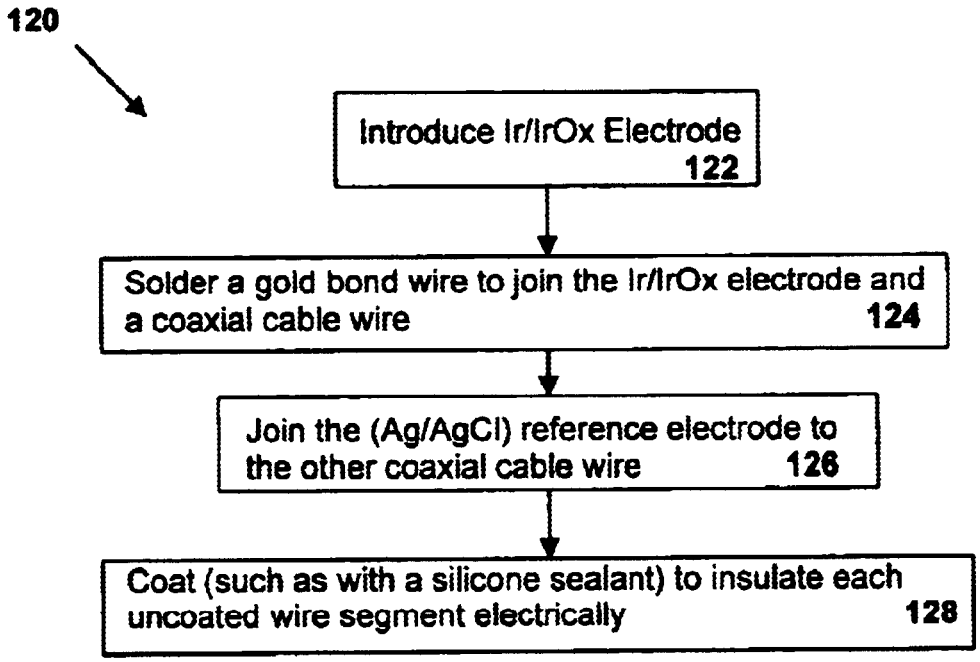
FIG. 4 is a flowchart showing the steps, for forming an acidity sensor in accordance with one embodiment of the present invention.

Referring now to FIG. 4, two or more electrodes of appropriate materials may be employed as a sensor. The present invention provides for a plurality of electrodes in a sensor to be formed using these methods. The figures show data where one electrode uses an $IrO_x$ solid on an Ir wire while the other electrode uses a conventional AgCI solid on an Ag wire formed by chloridizing the wire in a 1 M FeCI3 solution. Only the $Ir/IrO_x$ electrode was formed using the method and apparatus of this convention. Note that the iridium and silver metal substrates are optional because an solid can be attached directly to an electrical lead without an intervening material.

A number of pH sensing mechanism for the $Ir/IrO_x$ electrode have been proposed, the most feasible one is considered to be:

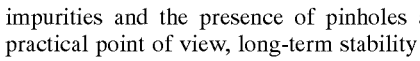

$$2IrO_2+2H^++2e^-=Ir_2O_3+H_2O$$

$$E=E^\circ-2.303RT/F\ pH$$

where E°=922 mV (vs. SHE), R, T and F have their usual meaning. The Nernstian slope of 2.303RT/F is 59.16 mV/pH at 25° C. The E° value is 923.3 mV, which is very close to the theoretical value associated with the reactions. However, the apparent standard potential (E°) is dependent not only on the oxidation state of the iridium oxide film, but also on impurities and the presence of pinholes as well. From a practical point of view, long-term stability is a very important parameter.

Within a given range of temperature and other environmental parameters, such as moisture, a sensor's shelf life depends principally on diffusion constants and other time-dependent influences effecting the stability of the constituent compounds. Drift during storage or operation is observed as a difference between calibration and the actual measured acidity E°, and generally will systematically affect the slope or intercept of voltage as a function of acidity. The further corrections due to temperature compensation should be close to constant over time (i.e. low/no drift) when compared to the value at an earlier time at the same temperature. One advantage of the electrodes and sensors formed from them is the reduction in drift compared to other known alternatives. Another advantage is the reversibility with respect to, and smallness of the hysteresis arising from, excursions across temperature, acidity, pressure, and pressure.

The range of pH values that can be measured may depend on the stability of the materials forming the sensor to resist attack by alkalis or acids, as well as to the presence of reducing agents. Strong reducing agents can diminish a sensor's accuracy and degrade its lifetime. The electrode is resistant to interference from phosphate, acetate, citrate, borate, chloride, sodium chloride, nitrate, and sulfate ions in solution. Competing sensors show susceptibility to inaccuracy induced by some or all of these ions.

Figure 5A:
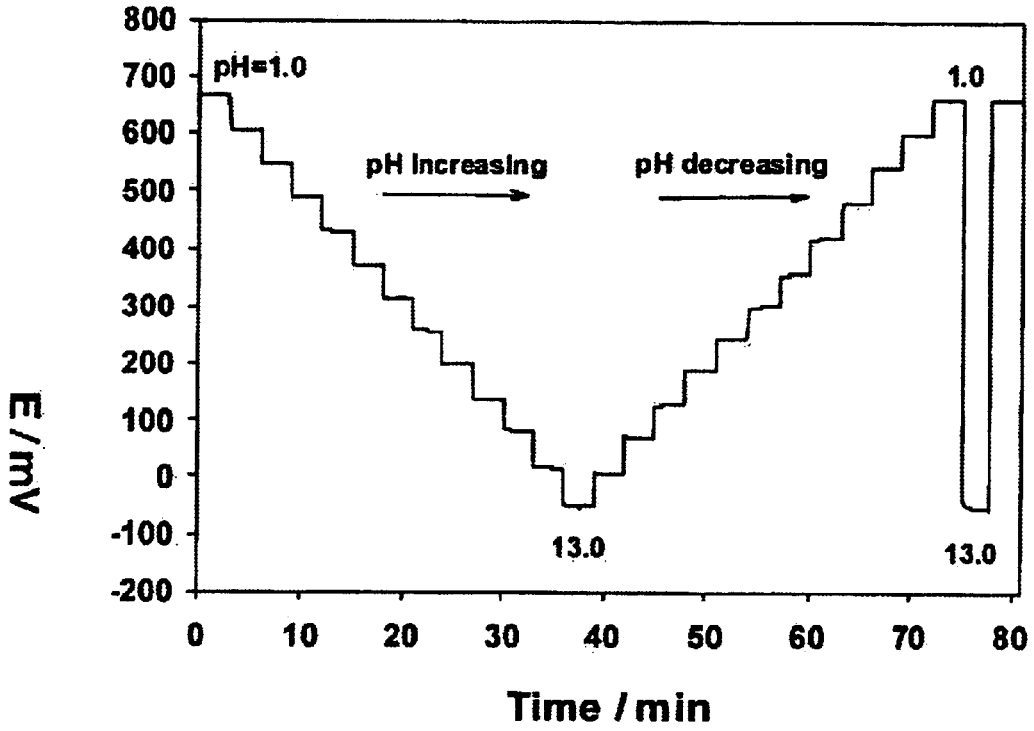
FIGS. 5*a* and 5*b* show measurements of an acidity sensor in accordance with one embodiment of the present invention.
Figure 5B:
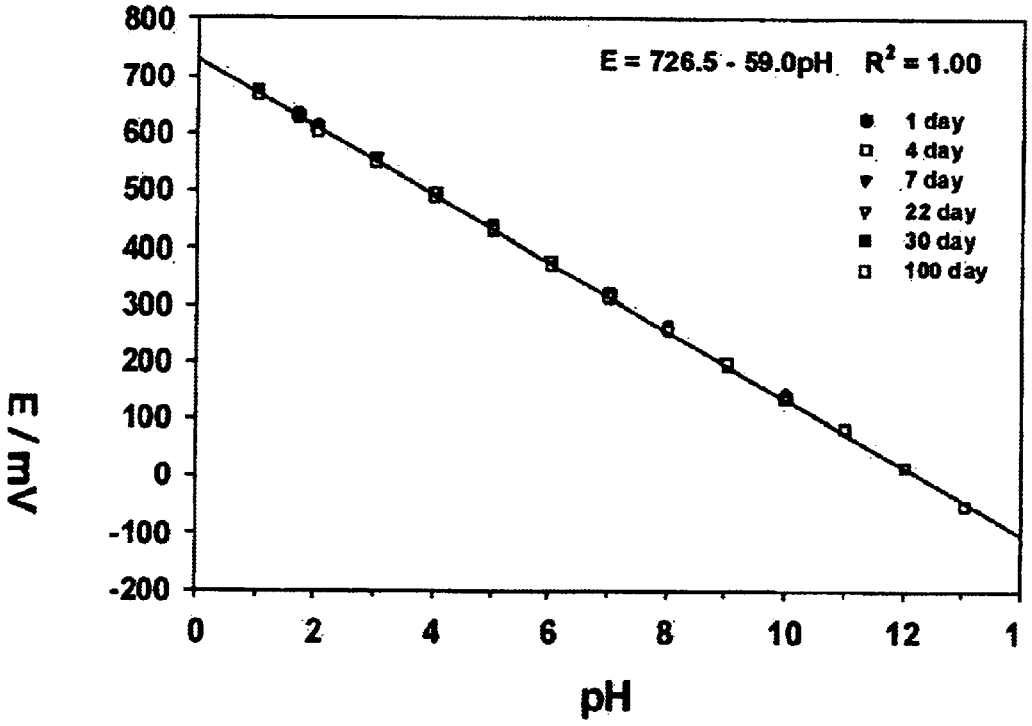

Referring now to FIGS. 5(*a*) and 5(*b*), a preferred acidity (pH) sensor may be formed by pairing two electrodes, at least one of which is formed using a preferred method or state of matter. A first solid holds a potential voltage with respect to a second solid, the voltage being indicative of the acidity of a material communicating fluidically or electrically with the first and second materials. In a preferred embodiment, the sensors will report the pH of an ambient fluid.

In a preferred apparatus, an $IrO_x$ electrode as described above is paired with a commercial reference electrode. The reference electrode provides an Ag/AgCI wire immersed in a KCI electrolyte solution, communicating to the liquid under test through a plurality of pinholes. The $IrO_x$ wire is immersed directly into the liquid under test. The sensors have excellent accuracy, range, draft-free reproducibility, and long-term stability.

It is anticipated that more complicated structures may be constructed using objects of the present invention. For instance, three-electrode and four-electrode bridges may allow a cathode to be paired against a multiplicity of anodes, which can be particularly valuable if different materials are used in the anodes. The opposite may be true for an anode paired with multiple cathodes, or for multiplicities of cathodes as well as anodes. Interdigitated stripings may allow integration over a surface area with fast response time. A built-in temperature sensor may advantageously be formed with an explicit temperature sensing circuit or by combining sensors with different temperature dependencies.

There are many ways to read the voltage representing the sensed chemical value, with constraints from different applications suggesting different technological means for reading the voltage. A voltmeter is a standard reading device that may be used as a preferred method, but typically necessitates excellent electrical shielding, expensive BNC connectors, and a costly digital multimeter with high source impedance. Pre-amplification near the sensor, such as by a field effect transistor, allows use of inexpensive meters, cabling, and connectors. The sensed values may advantageously be encoded or modulated, usually after boosting the signal with a FET powered by-a local or remote power source. For instance, a voltage controlled oscillator (VCO) reports the sensed values as frequencies, such that the output signal is less susceptible to ambient electrical noise. Measuring the signal in a time-dependent way, such as by toggling the connections across one or more relays, can improve noise immunity and calibration. It also facilitates multiplexing power and signal paths onto fewer electric leads.

A local light source such as a light-emitting or laser diode may be used to generate a signal modulated by the sensed value, which may then be sent through free space or carried through a fiber. The voltage reading device may include a microelectromechanical device, utilizing a Leydenjar-like electrode to indicate the sensed voltage by deflection or resonance change: This illustrates how one or more electrodes can avoid the use of externally accessible electrical leads by employing the solids directly in polarizable structures, which indicate a voltage or voltage threshold without necessarily needing an external voltmeter for the voltage sensing means.

As another example, the $IrO_x$ and AgCI solids may be used as capacitor plates in a capacitor structure whose dielectric material (e.g. a liquid crystal) indicates the applied voltage, and can be read directly by well-known optical means, such as by reading the polarization or cross-polarized attenuation of light. Many capacitor structures are well-known, and may advantageously make use of internal reflections and critical angles of reflection. These and other reading devices may be employed in accordance with the present invention.

Many reading devices can be employed as arrays of reading means, especially if each element is tuned to a limited pH range, like organ pipes. The MEMS and optical approaches may advantageously be constructed in ways that eliminate the need to bring clean electrical power to the sensor.

Since the sensor produces a voltage at extremely low current, and since the source impedance of the reader correlates with the drift and usable lifetime of the sensor, higher source impedance generally implies longer sensor lifetime. However, low source impedance allows low cost connectors and meters, and generally reduces the susceptibility to electromagnetic interference. An advantage of a solid state sensor, formed by conventional methods but using $IrO_x$ and Ag/AgCI, is its tolerance of relatively lower source impedance voltage reading means than traditional glass-based sensors (e.g. $10^9$ versus $10^{12}$ Ohms). An advantage of the solids used to form a preferred $IrO_x$ electrode, even if using conventional Ag/AgCI electrodes, is an even greater tolerance of lower source impedance, e.g. $10^6$ Ohms.

Open circuit potential (OCP) of the present invention is improved by orders of magnitude over previous observed OCP values. Unsurprisingly, the best source impedance is an open circuit that has infinite source impedance. A relay may be used to produce an open circuit between the sensor and the reading device when readings are not being taken. Infinite source impedance during storage extends the sensor's shelf life and reduces drift. Reducing the duty cycle by effectively disconnecting the sensor between measurements may make the circuit infinite impedance, except for the occasional times when measurements are being taken, extending the sensor's stable operating life and reducing drift. A time-dependent voltage waveform, such as a battery with a relay, may also be used to cancel the potential between the electrodes, and may be easier to provide than high quality relay hardware.

Telemetry may be used advantageously with the sensor. For instance, the use of radios, magnetic induction RF, and programmable passive transponders are all well known. Telemetry may be used to avoid the use of wires and fibers, e.g. for ingested or implanted sensors reporting acidity, or hypercarbia for medical tonometry or transplant applications. Such systems may draw power by induction from the impinging waveform, thereby avoiding any use of on-board battery materials. The core of a magnet used in a transformer (e.g. in a telemetry circuit) may advantageously be used to house the sensor body.

The area of the solid used to sense may advantageously be optimized for the constraints of the application, even miniaturized to submicron size where necessary, although areas of 1 $mm^2$ and larger might be used in certain embodiments. Advantages that follow from smaller sizes may suggest embodiments in small form factors, such as inside a needle or on a surgical staple. Smaller size may also result in lower cost of materials and mass producibility, greater durability or redundancy; and so forth. Alternatively, larger areas may advantageously decrease the minimum source impedance needed for the voltmeter detector. Larger areas may also sample a larger, possibly more representative surface of the material under test. Larger devices may also be produced with greater ruggedness or lower cost in batch production.

Response time may be dominated by diffusion constants, which are typically much longer than the chemical reaction itself. A system requiring faster response time may artificially increase the rate of surface irrigation, such as by vibrating the surface or forcing increased fluid flow.

Sensors with preferred solids may be temperature sensitive, which may be disadvantageous unless sensor operation, and possibly storage, is confined to a narrow temperature range or the temperature effects are calibrated out. Compound sensors may have further temperature dependencies, such as in the bicarbonate buffer and gas permeable membrane used to form a carbon dioxide sensor from an acidity sensor. Measurements of acidity at various known concentrations and temperatures show continuous, continuously differentiable values, such that the sensed value could be corrected for each sensor. This may be accomplished by means of a functional form (e.g. a polynomial), lookup table, or other isomorphic relationship. A linear Nemstian response could be retrieved after such corrections, so long as the temperature is also known. It is therefore advantageous to know the temperature at the sensor, and may also be advantageous to employ a temperature sensor along with the sensor.

Temperature sensors are well known to electrochemists, notably including RTDs, thermocouples, temperature dependent electronic circuits, and materials with well-defined temperature dependencies such as phase transitions. The distinct temperature dependence of other electrodes, including acidity sensors, may also be used to provide a second measurement along with the uncorrected acidity measurement. Two measurements may be used in concert to indicate true, temperature-corrected acidity without necessarily revealing the absolute temperature itself.

Figure 6:
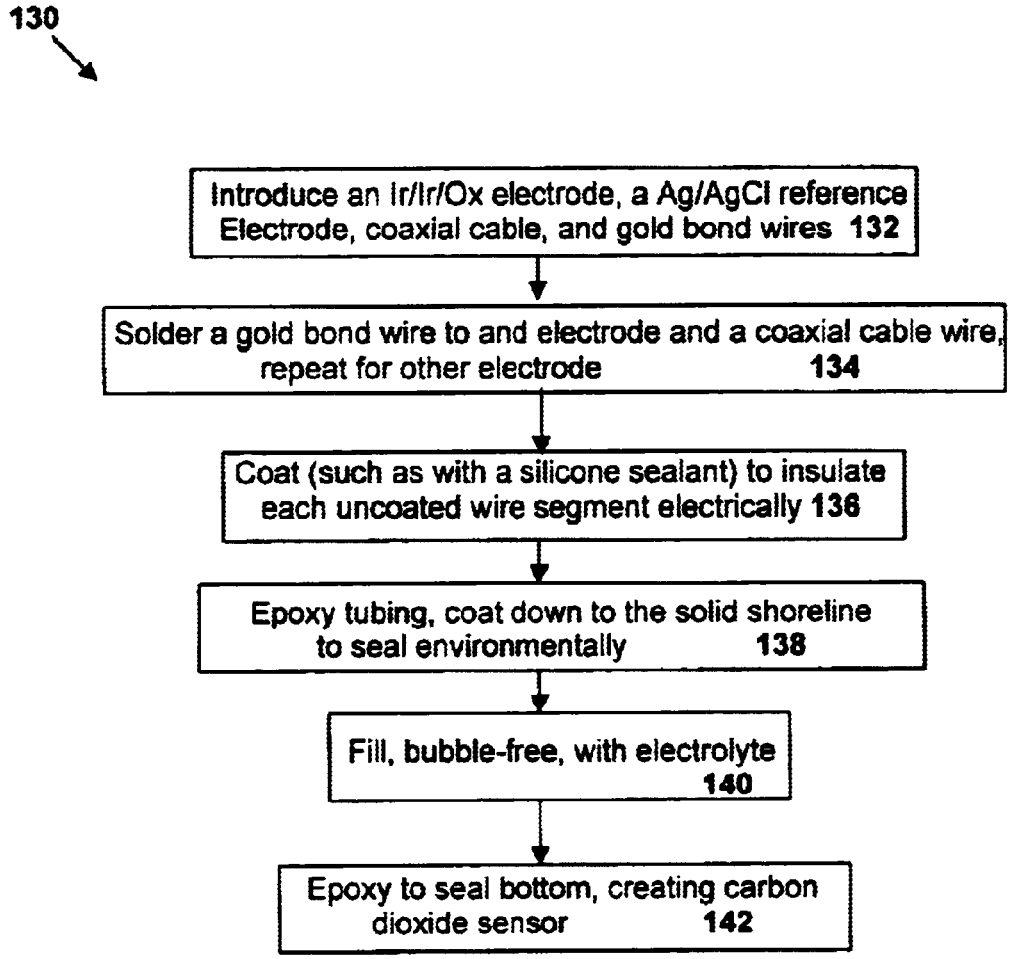
FIG. 6 is a flowchart showing the steps for forming a carbon dioxide sensor in accordance with one embodiment of the present invention.

Referring to FIG. 6, the acidity sensor may be used as a basic device for building other useful sensors, which may relate the concentration of a sensed material to an acidity, and then to a measurable potential E°. Apparatuses are envisioned for compound sensors measuring carbon dioxide, urea, oil degradation, or other material concentrations.

A preferred embodiment of a carbon dioxide sensor uses a Severinghaus design, and is particularly well suited for reading high concentrations of $CO_2$, such as those found in healthy or hypercarbic animals. In a Severinghaus design, an acidity sensor reads the concentration of carbon dioxide in a bicarbonate material as a change in acidity. A typical reaction is given by:

$$HCO_3^- = CO_2 + OH^-.$$

The bicarbonate may preferably be carried in an electrolytic fluid or a hydrogel like poly (hydroxyethylmethacrylate) or agar. The bicarbonate may be prevented from leaching away by being trapped between the acidity sensor and a gas permeable membrane. The membrane may be formed from silicone rubber or other semi-permeable materials with appropriate mechanical and chemical stability under storage and use conditions.

In a preferred embodiment of a carbon dioxide sensor, an $IrO_x$ electrode as described above is bonded to a wire in a coaxial cable by way of a 1 mm long gold filament. A conventional Ag/AgCI wire is similarly bonded. Thermal solder bonding is preferably used, but wedge bonding, brazing, welding, or other attachment methods may be used instead if their properties are satisfactory. Satisfactory properties preferably include temperature range, metallurgical stability, and galvanic junction potentials. The exposed wires from the coaxial cable and the gold wires are then painted with non-hygroscopic epoxy. One end of a 2 cm long thin-walled silicone rubber tube is then drawn over them. The epoxy is preferably cured by drying for 24 hours, or by heating or ultraviolet radiation. The epoxy is preferably chosen for considerations including its unreactivity with the electrode solids, match to the brittleness of the coaxial tubing and silicone tubing, stability and durability.

The tubing may be filled with a bubble-free 1 M bicarbonate solution, the end of the tubing then sealed with epoxy and cured. Alternatively, the end may be sealed by jabbing the tubing into fresh epoxy, injecting the electrolyte through a needle as the air is drawn out, and then curing the epoxy. A two-lumen silicone tube may be used to prevent the electrodes from contacting, especially if the tube has pores in the intervening septum. A second (or third) lumen may be used to draw the electrolyte, if a liquid circuit is left as a gap between the end of the wire-bearing lumen (or lumens) and the start of the drawing lumen, although such a use increases the proof volume (hence response time) of the sensor and still requires sealing of wet epoxy against electrolyte. Many other structures for immersing the electrodes in a bicarbonate bearing hydrogel or electrolyte and sealing the ensemble with a gas permeable membrane are usable, and the inventors anticipate that practitioners of sensor packaging and MEMS fluidics may apply them here without adding novelty.

Figure 7:
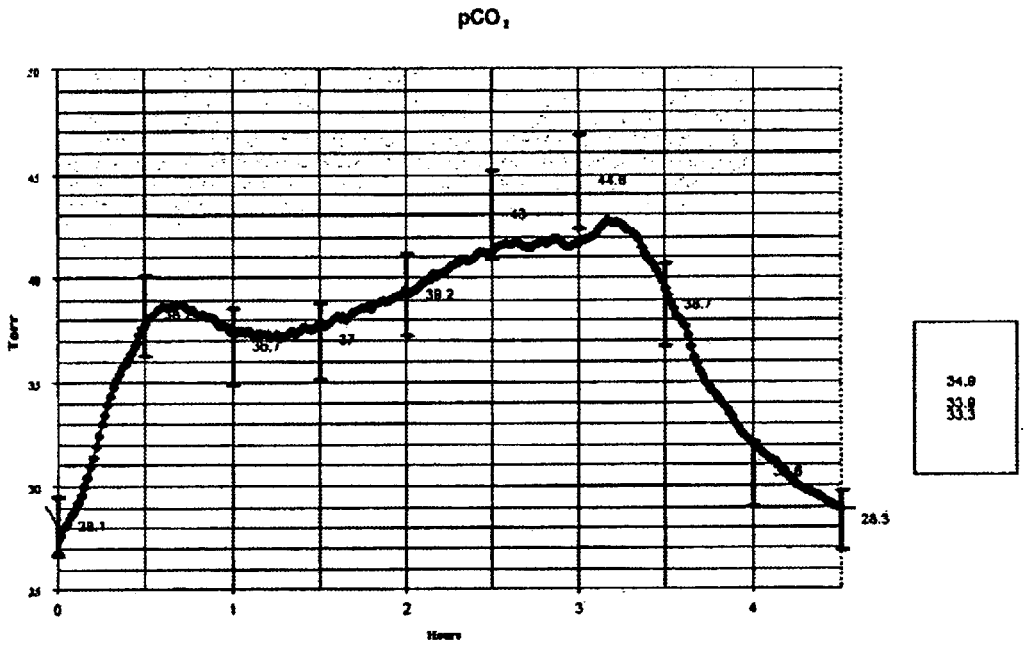
FIG. 7 shows data comparing a carbon dioxide sensor in accordance with one embodiment of the present invention and a blood gas machine, both reporting tonometric hypercarbia data in a sheep trauma experiment.

Referring now to FIG. 7, both sensors report tonometric hypercarbia data from a sheep trauma experiment. Using standard, NIH-approved animal surgical protocols, a preferred carbon dioxide sensor and a Tonometrics-brand saline catheter were placed in the intestine of an anaesthetized sheep, where they would measure the animal's intestinal mucosal carbon dioxide partial pressure. The E° from the sensor was polled each minute, converted to $pCO_2$. These readings are plotted as diamond shapes. A saline sample was drawn twice hourly from the equilibrated Tonometrics catheter and its $pCO_2$ read by a commercially available blood gas machine (shown with error bars). The readings are medically identical, and indicate the response of an animal to the onset of shock, resuscitation, and death.

The response time of a carbon dioxide sensor of the present invention is dominated by the diffusion time across the membrane and equilibration of the bicarbonate reservoir. In a preferred embodiment, a 50 $\mu$m thick silicone rubber membrane and 10 $\mu$l of electrolyte took 20 minutes for $\tau$=1/e. Note that $\tau$ is temperature-dependent. There should be exponential speedup of $\tau$ as the wall thickness and proof volume are reduced.

Since the acidity sensors can be mass produced in planar form, a planar embodiment of a carbon dioxide sensor may be formed by laminating sheets containing arrays of acidity sensors, drops of hydrogel in epoxy moats, and a membrane sheet. The epoxy is subsequently cured, and the neighboring sensors cut apart. Other methods of fabrication without epoxy, as well as other ways of bringing sensor leads out of the acidity sensor substrate, properties of the membrane and coatings, and other details of system fabrication may be used.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, it will be within the ability of one of ordinary skill in the art to make alterations or modifications to the present invention, such as through the substitution of equivalent materials or structural arrangements, or through the use of equivalent process steps, so as to be able to practice the present invention without departing from its spirit as reflected in the appended claims, the text and teaching of which are hereby incorporated by reference herein. It is the intention, therefore, to limit the invention only as indicated by the scope of the claims and equivalents thereof.

REFERENCES

1. R. Bates, Determination of pH—*theory and practice*, John Wiley & Sons, New York (1973).
2. M. J. Madou and S. R. Morrison, *Chemical Sensing with Solid State Devices*, Academic Press, New York (1989).
3. R. E. F. Einerhand, W. H. M. Visscher, E. Barendrecht, *Electrochim. Acta*, 34, 345 (1989).
4. D. J. G. Ives and G. J. Janz, *Reference Electrodes*, Academic Press, New York (1961).
5. W. T. Grubb and L. H. King, *Anal. Chem.*, 52, 270 (1980).
6. C-C. Liu, B. C. Bocchicchio, P. A. Overmyer and M. R. Neuman, *Science*, 207, 188 (1980).
7. A. Fog and R. P. Buck, *Sensors & Actuators*, 5, 137 (1984).
8. K. Pásztor, A. Sekiguchi, N. Shimo, N. Kitamura and H. Masuhara, *Sensors & Actuators*, B13-14, 561 (1993).
9. H. N. McMurray, P. Douglas and D. Abbot, *Sensors & Actuators*, B28, 9 (1995).
10. L. D. Burke, J. K. Mulcahy and D. P. Whelan, *J. Electroanal. Chem.*, 163, 117 (1984).
11. E. Kinoshita, F. Ingman, G. Edwall, S. Thulin and S. Glab, *Tananta*, 33, 125 (1986).
12. M. L. Hitchman and S. Ramanathan, *Analyst*, 113, 35 (1988).
13. W. Olthuis, M. A. M. Robben, P. Bergveld, M. Bos and W. C. Van Der Linden, *Sensors & Actuators*, B2, 247 (1990).
14. I. Song, K. Fink and J. H. Payer, *Conosion*, 54, 13 (1998).
15. R. K. Jaworski and J. A. Cox, *J. ElectroanaL Chem.*, 325, 111 (1992).
16. J. E. Baur, T. W. Spaine, *J Electroanal. Chem.*, 443, 208 (1998).
17. T. Katsube, I. Lauks and J. N. Zemel, *Sensors & Actuators*, 2, 399 (1982).
18. I. Lauks, M. F. Yuen and T. Dietz, *Sensors & Actuators*, 4, 375 (1983).
19. M. J. Tarlov, S. Semancik and K. G. Kreider, *Sensors & Actuators*, B1, 293 (1990).
20. A. Kato, Y. Konno, Y. Yanagida, M. Yamasato, T. Taguchi, R. Motohashi and T. Katsube, *Anal. Sci.*, 7 supplement, 1577 (1991).
21. K. G. Kreider, M. J. Tarlov and J. P. Cline, *Sensors &Actuators*, B28, 167 (1995).
22. J. V. Dobson, P. R. Snodin and H. R. Thirsk, *Electrochim. Acta*, 21, 527 (1976).
23. G. Papeschi, S. Bordi, M. Carla, L. Criscione and F. Ledda, *J. Med. Eng. & Tech.*, 5,86(1981).
24. S. Ardizzone, A. Carugati and S. Trasatti, *J. Electroanal. Chem.*, 126, 287 (1981).
25. K. Kinoshita and M. J. Madou, *J. Electrochem. Soc.*, 131,1089 (1984).
26. M. L. Hitchman and S. Ramanathan, *Talanta*, 39,137 (1992).
27. M. L. Hitchman and S. Ramanathan, *Anal. Chim. Acta*, 263, 53 (1992).
28. M. L. Hitchman and S. Ramanathan, *Analyst*, 116, 1131 (1991).
29. P. J. Kinlen, J. E. Heider and D. E. Hubbard, *Sensors & Actuators*, B22, 13 (1994).
30. K. Izutsu and H. Yananoto, *Anal. Sci.*, 12, 905 (1996).
31. S. Gottesfeld and J. D. E. McIntyre, *J. Electrochem. Soc.*, 126, 742 (1979).
32. D. N. Buckley,L. D. Burke and J. K. Mulcahy, *J. Chem. Soc. Faraday Trans.*, 1, 72, 1896 (1976).
33. L. D. Burke and D. P. Whelan, *J. Electroanal. Chem.*, 162, 121 (1984).
34. M. J. Madou, *Fundamentals of Microfabrication*. CRC Press, New York (1997).
35. P. G. Pickup and V. I. Birss, *J. Electrochem. Soc.*, 135, 126 (1988).
36. B. E. Conway and J. Mozota, *Electrochim. Acta*, 28, 9 (1983).
37. S. Gottesfeld and J. D. E. Mclntre, *J. Electrochem. Soc.*, 126, 742 (1979).
38. C. G. Joo, C. W. Yi, C. Kang and K. Kim, *J. Power Sources*, 72, 211(1998).
39. R. L. Every, *J. Electrochem. Soc.*, 112, 524 (1965).
40. G. J. Janz, A. Conte and E. Neuenschwander, *Corrosion*, 19, 292 (1963).
41. P. Claes, B. Thirion, J. Glibert, *J. Electroanal. Chem.*, 389, 37 (1995).
42. M. Spiegel, P. Biedenkopf and H J. Grabke, *Corr. Sci.*, 39, 1193 (1997).
43. B. Malinowska, M. Cassir, F. Delcorso, J. Devynck, *J. Electroanal. Chem.*, 21, 389 (1995).
44. M. Cassir, M. Olivry, V. Albin, B. Malinowska, J. Devynck, *J. ElectroanaL Chem.*, 462,127 (1998).

45. T. Nishina, I. Uchida and J. R. Selman, *J. Electrochem. Soc.*, 141, 1191 (1994).
46. K. P. Ta and J. Newman, "Proton Intercalation Hysteresis in Charging and Dischargeing Nickel Hydroxide Electrodes." *J. Electrochem. Soc.*, 146, 8 (1999).
47. U.S. Pat. No. 5,480,534 )1/96) by Akihiko Kato
48. 95106312.2 (4/95) European patent office.

What is claimed is:

1. A method for forming an iridium oxide solid, said method comprising the steps of:

exposing iridium metal to an alkali metal carbonate at a temperature sufficient to oxidize said iridium metal; and applying a voltage between said iridium metal and said alkali metal carbonate so as to drive said oxidizing iridium metal toward a maximum oxidation state.

2. The method for forming an iridium oxide solid of claim 1, wherein said exposing of said iridium metal to said alkali metal carbonate is accomplished by a technique selected from the group consisting of: immersing said iridium metal in a bath of liquid alkali metal carbonate, applying liquid alkali metal carbonate to said iridium metal, depositing said iridium metal and said alkali metal carbonate sequentially and heating until one liquefies, bombarding said alkali metal carbonate with ions containing said iridium metal, bombarding said iridium metal with ions containing said alkali metal carbonate, condensing said alkali metal carbonate from a vapor phase onto said iridium metal, and condensing said iridium metal from a vapor phase onto said alkali metal carbonate.

3. The method for forming an iridium oxide solid of claim 1, wherein said application of a voltage between said iridium metal and said alkali metal carbonate is accomplished by a technique selected from the group consisting of: applying a galvanic potential across a bimetallic junction, utilizing the potential from a voltage-regulated power source connecting said iridium metal and said alkali metal carbonate in a circuit, and utilizing the potential from a battery connecting said iridium metal and said alkali metal carbonate in a circuit.

4. The method for forming an iridium oxide solid of claim 1, further comprising the step of cleaning said iridium metal.

5. The method for forming an iridium oxide solid of claim 4, wherein said cleaning is accomplished by application of chemicals selected from the group consisting of: acetone, hydrochloric acid and de-ionized water.

6. The method for forming an iridium oxide solid of claim 1, further comprising the step of drying said iridium metal wire.

7. The method for forming an iridium oxide solid of claim 6, wherein said drying consists of drying said wire in an electric oven.

8. The method for forming an iridium oxide solid of claim 1, wherein said alkali metal carbonate is in powder form.

9. The method for forming an iridium oxide solid of claim 1, wherein said alkali metal carbonate is selected from the group consisting of: lithium carbonate and sodium carbonate.

10. The method for forming an iridium oxide solid of claim 1, further comprising the step of descumming said oxidized iridium metal.

11. The method for forming an iridium oxide solid of claim 1, wherein said iridium metal is oxidizes by ambient oxygen.

12. The method for forming an iridium oxide solid of claim 11, wherein said ambient oxygen is atmospheric oxygen.

13. A method for forming an iridium oxide solid electrode, said method comprising the steps of:

forming an iridium oxide solid, said iridium oxide solid formed by the method of:

(i) exposing iridium metal to an alkali carbonate at a temperature sufficient to oxidize said iridium metal;

(ii) applying a voltage between said iridium metal and said alkali metal carbonate so as to drive said oxidizing iridium metal toward a maximum oxidation state; and depositing said iridium oxide solid on at least one surface of an electrical lead, said electrical lead conductively attached to said iridium oxide solid.

14. A method for forming an iridium oxide solid electrode according to claim 13, wherein said electrical lead is gold.

15. A method for forming an iridium oxide solid electrode according to claim 13, wherein said iridium metal is oxidized by ambient oxygen.

16. A method for forming an iridium oxide solid electrode according to claim 15, wherein said ambient oxygen is atmospheric oxygen.

17. A method for forming an iridium oxide solid electrode, said method comprising the steps of:

forming an iridium oxide solid, said iridium oxide solid formed by the method of:

(i) exposing iridium metal to an alkali carbonate at a temperature sufficient to oxidize said iridium metal;

(ii) applying a voltage between said iridium metal and said alkali metal carbonate so as to drive said oxidizing iridium metal toward a maximum oxidation state; and depositing said iridium oxide solid on at least one surface of a metal substrate, said metal substrate conductively attached to said iridium oxide solid; and conductively connecting an electrical lead to said metal substrate, so as to form an iridium oxide electrode.

18. A method for forming an iridium oxide solid electrode according to claim 17, wherein said metal substrate is iridium.

19. A method for forming an iridium oxide solid electrode according to claim 17, wherein said electrical lead is gold.

* * * * *

UNITED STATES PATENT AND TRADEMARK OFFICE

CERTIFICATE OF CORRECTION

PATENT NO. : 6,863,792 B1
DATED : March 8, 2005
INVENTOR(S) : Madou et al.

It is certified that error appears in the above-identified patent and that said Letters Patent is hereby corrected as shown below:

Title page,
Item [56], References Cited, OTHER PUBLICATIONS, please delete "Hitchman, M. et al., "Evaluation of Iridium Oxide Electrodes Formed by Potential Cycling as pH Probes", . Analyst, 113 35 (1988). " and insert -- Hitchman, M. et al., "Evaluation of Iridium Oxide Electrodes Formed by Potential Cycling as pH Probes", Analyst, 113, 35 (1988). --.
Item [57], ABSTRACT, please delete "A conductive oxide solid formed through an electrochemical process. The resulting solid predominantly contains oxides of the highest oxidation state. Additionally, the solid can be thick, uniform, stable across a wide range of acidity and temperature, fully hydrated, and conductive with a very low redox potential. A preferred embodiment is an iridium solid formed at high temperature in molten carbonate, said solid containing intercalated lithium. The solid has application as an electrode with reduced drift. An electrochemical acidity sensor is disclosed which pairs an electrode bearing the solid with a reference electrode. Additionally, sensor apparatuses for measuring carbon dioxide and other materials as well as methods for measuring materials using an embedded acidity sensor are disclosed." and insert – A conductive oxide solid formed through an electrochemical process. The resulting solid predominantly contains oxides of the highest oxidation state. Additionally, the solid can be thick, uniform, stable across a wide range of acidity and temperature, fully hydrated, and conductive with a very low redox potential. A preferred embodiment is an iridium oxide solid formed at high temperature in molten carbonate, said solid containing intercalated lithium. The solid has application as an electrode with reduced drift. An electrochemical acidity sensor is disclosed which pairs an electrode bearing the solid with a reference electrode. Additionally, sensor apparatuses for measuring carbon dioxide and other materials as well as methods for measuring materials using an embedded acidity sensor are disclosed. --.

Column 1,
Line 34, please delete "(MOES)" and insert -- (MOEs) --.

Column 2,
Lines 53-54, please delete "ionizable– OH"and insert -- ionizable –OH --.
Line 62, please delete "–H" and insert -- –OH --.

Column 3,
Line 43, please delete "steps, for" and insert -- steps for --.

UNITED STATES PATENT AND TRADEMARK OFFICE

CERTIFICATE OF CORRECTION

PATENT NO. : 6,863,792 B1
DATED : March 8, 2005
INVENTOR(S) : Madou et al.

It is certified that error appears in the above-identified patent and that said Letters Patent is hereby corrected as shown below:

Column 4,
Line 10, please delete "purity>99%" and insert -- purity >99% --.
Line 41, please delete "Li+ions" and insert -- Li+ ions --.
Line 52, please delete "potental" and insert -- potential --.

Column 6,
Line 1, please delete "oxygen,from" and insert -- oxygen from --.

Column 7,
Line 9, please delete "$O_2$(diss.)+$2CO_3^{2-}$=$2O_2^{2-\square+}$ $2CO_2$" and insert -- $O_2$(diss.) + $2CO_3^{2-}$ = $2O_2^{2\square}$ + $2CO_2$ --.

Column 8,
Line 15, please delete "$HNO_3^-$ HCI$^{-H}{}_2$O" and insert -- $HNO_3^-$ HCI$^-$ $H_2O$ --.

Column 10,
Line 16, please delete "by-a" and insert -- by a --.
Line 28, please delete "Leydenjar-like" and insert -- Leyden-jar-like --.
Line 30, please delete "change:" and insert -- change, --.

Column 14,
Line 8, please delete "*Conosion*" and insert -- *Corrosion* --.
Line 27, please delete "5,86(1981)." and insert -- 5, 86 (1981). --.
Line 31, please delete "131,1089" and insert -- 131,1089 --.
Line 32, please delete "39,137" and insert -- 39,137 --.
Line 56, please delete "211(1998)." and insert -- 211 (1998). --.
Line 67, please delete "462,127" and insert -- 452,127 --.

UNITED STATES PATENT AND TRADEMARK OFFICE

CERTIFICATE OF CORRECTION

PATENT NO. : 6,863,792 B1
DATED : March 8, 2005
INVENTOR(S) : Madou et al.

It is certified that error appears in the above-identified patent and that said Letters Patent is hereby corrected as shown below:

Column 15,
Line 6, please delete ")1/96) " and insert -- (1/96). --.

Signed and Sealed this

Twenty-fourth Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,863,792 B1
DATED : March 8, 2005
INVENTOR(S) : Madou et al.

It is certified that error appears in the above-identified patent and that said Letters Patent is hereby corrected as shown below:

Title page,
Item [56], References Cited, OTHER PUBLICATIONS, please delete "Hitchman, M. et al., "Evaluation of Iridium Oxide Electrodes Formed by Potential Cycling as pH Probes", Analyst, 113 35 (1988)." and insert -- Hitchman, M. et al., "Evaluation of Iridium Oxide Electrodes Formed by Potential Cycling as pH Probes", *Analyst,* 113, 35 (1988). --.

Column 10,
Line 30, please delete "change:" and insert -- change. --.

Column 14,
Line 31, please delete "131,1089" and insert -- 131, 1089 --.
Line 32, please delete "39,137" and insert -- 39, 137 --.
Line 67, please delete "462,127" and insert -- 452, 127 --.

Column 15,
Line 6, please delete ")1/96)" and insert -- (1/96) --.

Signed and Sealed this

Thirtieth Day of August, 2005

JON W. DUDAS
*Director of the United States Patent and Trademark Office*